US007306097B2

(12) United States Patent
Wohlwender

(10) Patent No.: US 7,306,097 B2
(45) Date of Patent: Dec. 11, 2007

(54) GOLF BAG HAVING INTEGRATED SEATING PLATFORM

(76) Inventor: Thomas Angelo Wohlwender, 2771 NE. 58th St., Ft. Lauderdale, FL (US) 33308

( * ) Notice: Subject to any disclaimer, the term of this patent is extended or adjusted under 35 U.S.C. 154(b) by 170 days.

(21) Appl. No.: 11/094,058

(22) Filed: Mar. 30, 2005

(65) Prior Publication Data

US 2006/0219581 A1 Oct. 5, 2006

(51) Int. Cl.
*A63B 55/06* (2006.01)
*A63B 55/00* (2006.01)
*A63B 57/00* (2006.01)

(52) U.S. Cl. ..... 206/315.7; 206/315.3; 248/96; 297/188.01

(58) Field of Classification Search ..... 206/315.3, 206/315.7; 297/188.01, 188.12, 335, 217.1; 248/96; 190/8
See application file for complete search history.

(56) References Cited

U.S. PATENT DOCUMENTS 2,438,078 A * 3/1948 Sutphen ..... 280/655
2,610,077 A 9/1952 Swanson
2,944,593 A * 7/1960 Zarnke ..... 297/43
3,363,940 A * 1/1968 Miller ..... 297/217.1
4,078,594 A * 3/1978 Oeckl ..... 206/315.4
4,403,806 A 9/1983 Stephen
4,988,117 A * 1/1991 Shortall ..... 280/646
5,127,132 A * 7/1992 Karlin ..... 16/261
5,289,958 A 3/1994 Jay
D364,745 S 12/1995 Rettenberger
5,527,091 A * 6/1996 Gruber ..... 297/188.01
5,695,246 A * 12/1997 Tsai ..... 297/335
5,697,675 A * 12/1997 DeWitt et al. ..... 297/440.12
5,951,103 A * 9/1999 Barnhill ..... 297/248
5,957,349 A 9/1999 Krulik
6,151,736 A * 11/2000 Samuels ..... 5/653
6,273,250 B1 * 8/2001 Wu ..... 206/315.3
6,315,116 B1 11/2001 Suggs et al.
6,443,405 B1 * 9/2002 Han ..... 248/96
6,585,315 B1 * 7/2003 Vail ..... 297/186
7,040,635 B1 * 5/2006 Remole ..... 280/47.18
2002/0029832 A1 * 3/2002 Carlson ..... 150/110
2003/0019684 A1 1/2003 Wucherpfennig

FOREIGN PATENT DOCUMENTS

FR 2709973 A1 * 3/1995
GB 2295313 A * 5/1996

* cited by examiner

*Primary Examiner*—Sue A. Weaver

(57) ABSTRACT

A golf bag having an integrated seating platform is provided. The golf bag comprises a generally tubular body for housing a plurality of golf clubs; a generally solid and flat platform sized and configured to support a seated golfer; a coupler that interconnects the tubular body to the platform; and at least one leg that extends from the platform to a ground support surface.

9 Claims, 3 Drawing Sheets

GOLF BAG HAVING INTEGRATED SEATING PLATFORM

FIELD OF THE INVENTION

The present invention relates in general to the field of golf equipment and, in particular, to a golf bag having an integrated seating platform.

BACKGROUND OF THE INVENTION

Golf bags are used to hold a golfer's clubs and other equipment as the golfer either walks or employs a cart to circumnavigate the golf course while golfing. Many golfers prefer to walk for exercise, enjoyment or other reasons. Thus, smaller and lighter golf bags have been developed to ease the burden that the walking golfer must bear for the extended period of golfing time. The walking golfer desires the additional complexity of exercise or enjoyment without an undue strenuous burden.

One shortcoming that the walking golfer experiences when using a golf bag, however, is that regardless of its size and weight, the walking golfer may nevertheless find himself or herself in the undesirable situation of experiencing an undue strenuous burden, which significantly detracts from the enjoyment of the golf game. Moreover, the walking golfer is faced with several additional situations that the cart-golfer does not experience, such as the ready availability of a support surface upon which a scorecard can be filled out.

There is thus a need for a golf bag adapted to assist a walking golfer. There is also a need for a golf bag adapted to assist a golfer that may find the golfing experience or portions thereof to be unacceptably strenuous. There is also a more general need for an improved golf bag.

SUMMARY OF THE INVENTION

The present invention provides a golf bag adapted to assist a walking golfer. The present invention also provides a golf bag adapted to assist a golfer that may the golfing experience or portions thereof unacceptably strenuous. There is also a more general need for an improved golf bag.

One aspect of the invention provides a golf bag having an integrated seating platform comprising a generally tubular body for housing a plurality of golf clubs; a generally solid and flat platform sized and configured to support a seated golfer; a coupler that interconnects the tubular body to the platform; and at least one leg that extends from the platform to a ground support surface.

Another aspect of the invention provides a golf bag having an integrated seating platform comprising a generally tubular body for housing a plurality of golf clubs; a generally solid and flat platform sized and configured to accept and support a seated golfer, the platform having a plurality of legs attached thereto that are extendable to a ground support surface; and a coupler having a plurality of flexible rods that interconnects the tubular body to the platform.

Another aspect of the invention provides golf bag having an integrated seating platform comprising a generally tubular body for housing a plurality of golf clubs; a generally solid and flat platform sized and configured to accept and support a seated golfer, the platform having a plurality of legs attached thereto that are extendable to a ground support surface; and a coupler having at least one hinge that interconnects the tubular body to the platform.

BRIEF DESCRIPTION OF THE DRAWINGS

The present invention will now be described with reference to the drawings of the preferred embodiments of the present invention. The illustrated embodiments are intended to illustrate, but not to limit the invention. The drawings contain the following figures, in which like numbers refer to like parts throughout the description and drawings and wherein.

DETAILED DESCRIPTION OF THE PREFERRED EMBODIMENTS

The invention described herein employs several basic individual or collective concepts. For example, one concept relates to a golf bag having an integrated seating platform. Another concept relates to a golf bag having a readily available support surface.

The present invention is disclosed in context of use with a golf bag. The principles of the present invention, however, are not limited to golf bags, and those skilled in the art may find additional applications for the apparatus, processes, systems, components, configurations, methods and applications disclosed herein. For example, the seating platform can be used with other types of human carryable bags used with relatively strenuous physical human activity, such as duffel bags, equipment bags and the like. Thus, the illustration and description of the present invention in context of a golf bag is merely one possible application of the present invention. However, the present invention has been found particularly suitable in connection with golf bags.

Figure 1:
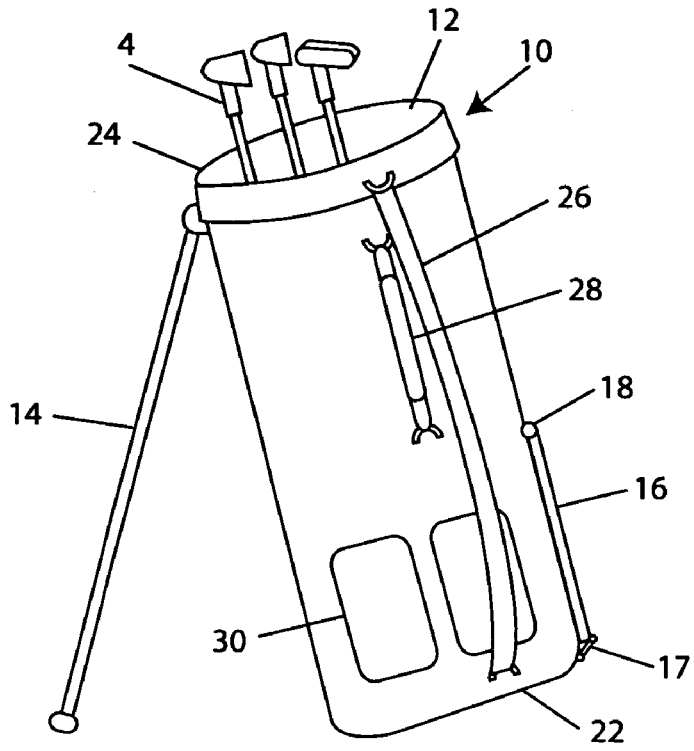
FIG. 1 is a perspective view of the golf bag of the present invention, showing a seat in a nondeployed position.
Figure 2:
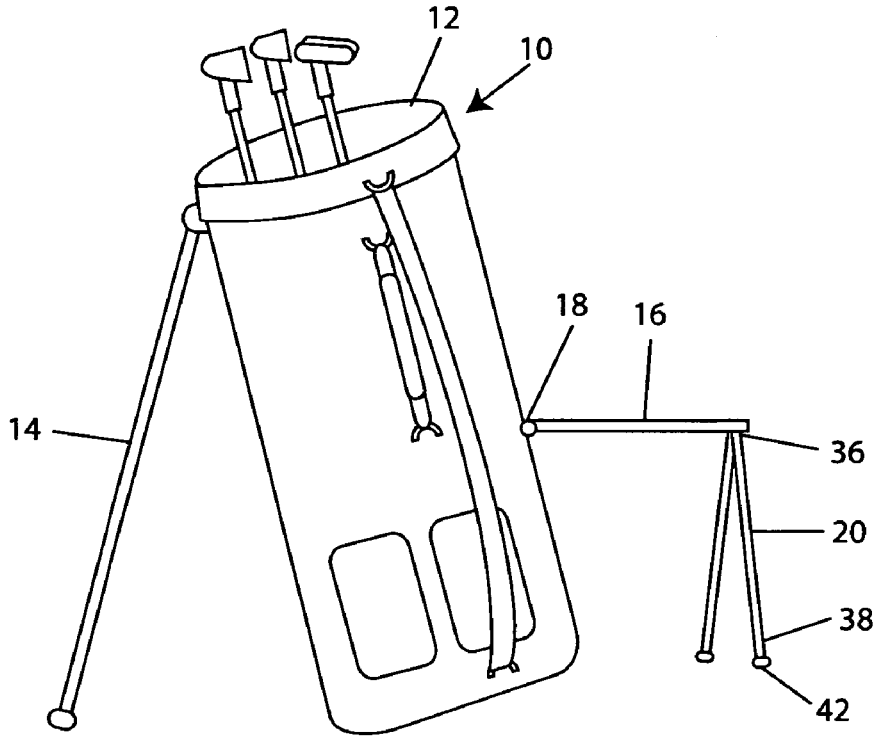
FIG. 2 is a perspective view of the golf bag of FIG. 1, showing the seat in a partially deployed position.
Figure 3:
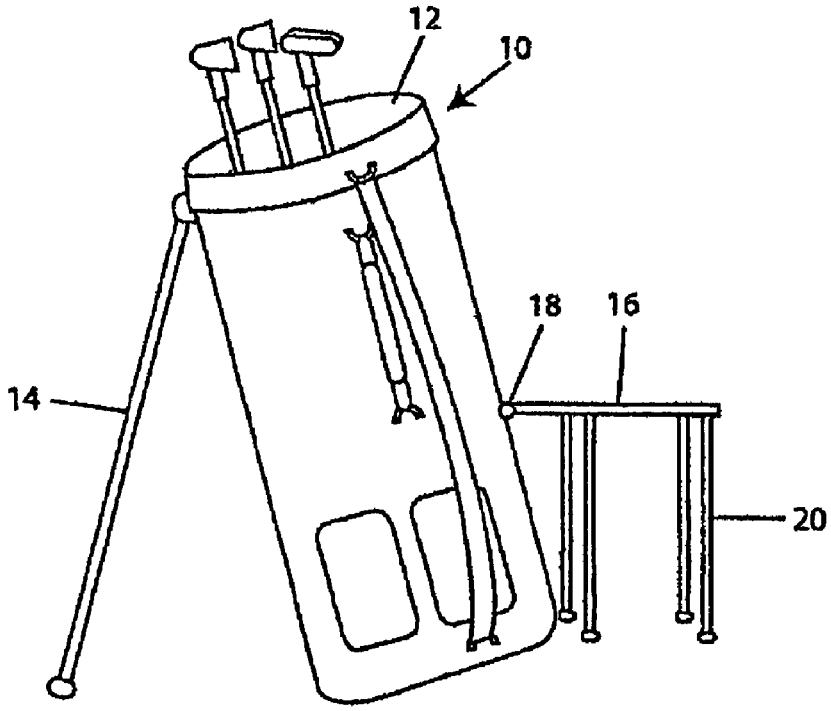
FIG. 3 is a perspective view of the golf bag of FIG. 1, showing the seat in a fully deployed position.

With reference to FIGS. 1-3, a general overview of the components and operation of the golf bag 10 of the present invention is provided, followed by a more detailed description of the components and operation. The golf bag 10 advantageously comprises a tubular body 12 for housing golf clubs 4 and is vertically supportable by a stand 14. A platform 16, configured to provide a seating surface, but advantageously adapted for additional provisions as described in more detail below, is integrated with the golf bag 10 by a coupler 18. The underside of the platform 16 includes a plurality of legs 20 to support the platform 16 when the platform 16 is in the deployed position. In operation, the golf bag 10 is advantageously carried by the walking golfer with the platform 16 in the nondeployed position (FIG. 1). When the golfer elects to sit or otherwise use the platform 16, the golfer extends the platform 16 to a partially extended position (FIG. 2), and then deploys the legs 20 to arrange the platform 16 in the fully deployed position (FIG. 3). Once in the fully deployed position, the golfer may sit on the platform 16 or use the platform 16 for other purposes, such as a writing surface upon which the golfer can mark his or her score upon completion of each hole.

Still referring to FIGS. 1-3, the illustrated golf bag 10 is formed as a tubular body 12 having a closed lower portion 22 and an open upper portion 24 such that the golfer can readily place the golf clubs 4 within the tubular body 12 and remove the golf clubs 4 from the tubular body 12 via the open upper portion 24. The tubular body 12 provides a storage area within which the golf clubs 4 are housed. A strap 26 and/or handle 28 is conventionally attached to the exterior of the tubular body 12 to assist the golfer in carrying the bag 10. Also, one or more pockets 30 are conventionally formed on the exterior of the tubular body 12 to store various golf equipment such as balls, tees, pencils, scorecards and the like.

The seat comprises a platform 16 that is advantageously integrated with the tubular body 12 of the golf bag 10 by a coupler 18 or other suitable device. The platform 16 has a seating surface that is generally solid and generally flat, preferably substantially solid and substantially flat, and more preferably solid and flat. The term "generally solid" means that at least 25% of the surface area bounded by the platform perimeter is a solid material (and that up to 75% of such surface area may be spacing or a non-solid material). The term "substantially solid" means that at least 50% of the surface area bounded by the platform perimeter is a solid material. The term "solid" means that at least 75% of the surface area bounded by the platform perimeter is a solid material. The term "generally flat" means that at least 75% of the platform has a curvature within 25%. The term "substantially flat" means that at least 75% of the platform has a curvature within 15%. The term "flat" means that at least 75% of the platform has a curvature within 5%. Thus, although the platform 16 is exemplarily illustrated as solid and flat, it 16 need not be solid or flat. For example, the platform 16 may be ergonomically contoured or otherwise curved to more comfortably assist in the seating or other function. For another example, the platform 16 may be embodied with steel or plastic mesh or straps, and optionally covered by cloth, leather or other material. However, it has been found that a solid and flat platform 16 is most preferred for seating comfort and storability.

The illustrated platform 16 is rectangular with a length of about 6-24 inches and preferably about 8-18 inches, and has a width of about 4-18 inches and preferably about 6-12 inches. It has been found that this dimensional range provides a good tradeoff between seating size (which is advantageously maximized) and bulk storable size (which is advantageously minimized). However, the platform 16 may take on a variety of other geometries, such as square, oval, circular, triangular, curved or polygonal. Also, the platform 16 may have one or more lengthwise or widthwise sides or portions that extend or telescope to provide a variable size seat.

The illustrated platform 16 has thickness of greater than 0.1 inch (preferably 0.25-2 inches, more preferably 0.5-1 inch) to provide suitable structural support to the seated golfer, although this thickness could be decreased by using stronger materials or support bars along selected portions of the platform 16 such as the edges or middle section as will be understood by those skilled in the art. Also, a thicker platform 16 reduces the amount of disadvantageous "give" that occurs when a golfer sits on the platform 16. The illustrated platform 16 is preferably arranged at a height of about 0.5-3 feet (preferably 1-2 feet) to provide a convenient seating surface, although this height could be increased to provide a leaning surface. The platform 16 is advantageously made of plastic due to its relatively low cost and high strength, however, it could be made of any suitably strong material such as metal, resin, wood, composites, combinations thereof and the like. A holding strap or clip 17 preferably removeably attaches the platform 16 to the golf bag 10.

Figure 4:
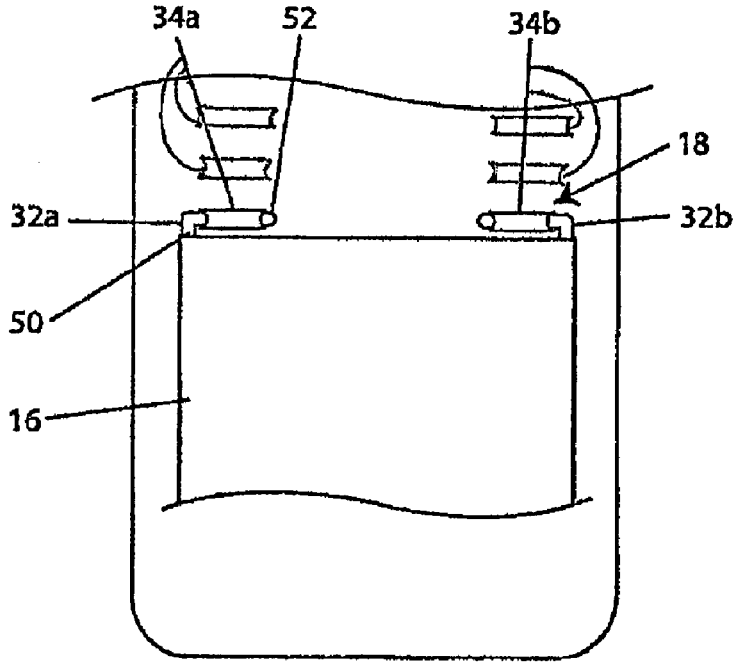
FIG. 4 is a detail perspective view of a coupler adapted to integrate the seat with the golf bag.

Referring to FIG. 4, a coupler 18 interconnects the golf bag 10 and platform 16. The illustrated coupler 18 is embodied as a pair of generally L-shaped rods 32*a*, 32*b* with a first end 50 attached to (but can alternatively be formed in unity with) and extending from the platform 16, and with a second opposite end 52 that interengages (or is alternatively formed in unity) with the golf bag 10. As illustrated, the second end 52 of the rods 32*a*, 32*b* interengage with a pair of tubes 34*a*, 34*b* that are sewn, glued, riveted, bolted, stapled or otherwise secured to the golf bag 10. Advantageously, the rods 32*a*, 32*b* can be manually flexed or contorted to fit into or out of each tube pair 34*a*, 34*b* for ease of seat height adjustability, and are rotatable within the tubes 34*a*, 34*b* for ease of seat deployability. The rods 32*a*, 32*b* and tubes 34*a*, 34*b* are preferably circular to assist with relative movement, but may and may take on a variety of cross-sectional geometries that provide for interengagement. The rods 32*a*, 32*b* may be made of a variety of strong materials such as steel, plastic, resin, wood, composites, combinations thereof and the like, and the tubes 34*a*, 34*b* may be made of similar materials as well as softer materials such as leather, nylon, cloth and the like. As will be understood by those skilled in the art, the rods 32*a*, 32*b* need not be L-shaped, may number less than two or more than three, and need not be arranged along the width of the platform 16 in order to achieve the desired function of interconnecting the platform 16 to the golf bag 10. Also, a plurality of pairs of tubes 34*a*, 34*b* may be vertically arranged along the height of the golf bag 10 to provide for platform 16 height adjustability. This cooperative rod 32 and tube 34 configuration advantageously allows the platform 16 to be quickly and easily removed from or attached to the golf bag 10, for example, if the golfer intends to golf using a golf cart the golfer can quickly and easily remove the platform 16 from the golf bag 10 prior to beginning play, for another example, if the golfer intends to walk while golfing the golfer can quickly and easily attach the platform 16 to the golf bag 10 prior to beginning play.

Figure 5:
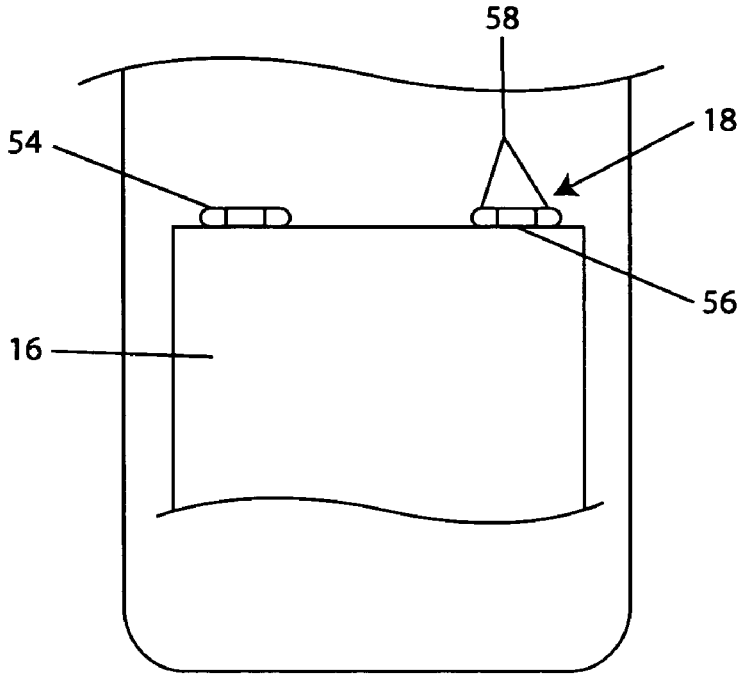
FIG. 5 is a detail perspective view of another coupler adapted to integrate the seat with the golf bag.

Referring to FIG. 5, an exemplarily alternative embodiment of the coupler 18 is shown. The illustrated coupler 18 is preferably embodied as a conventional hinge 54. Like with the rod and tube coupler of FIG. 4, the hinge 54 has a first portion 56 attached to (but can alternatively be formed in unity with) and extending from the platform 16, and a second portion 58 that interengages (or is alternatively formed in unity) with the golf bag 10. A hinge configuration will tend to provide a more permanent interconnection between the platform 16 and the golf bag 10, relative to the rod 32 and tube 34 configuration.

Similarly, those skilled in the art will understand that a many other types and arrangements of couplers can be used to achieve to object of removeably or permanently interconnecting the platform 16 to the golf bag 10.

Figure 6:
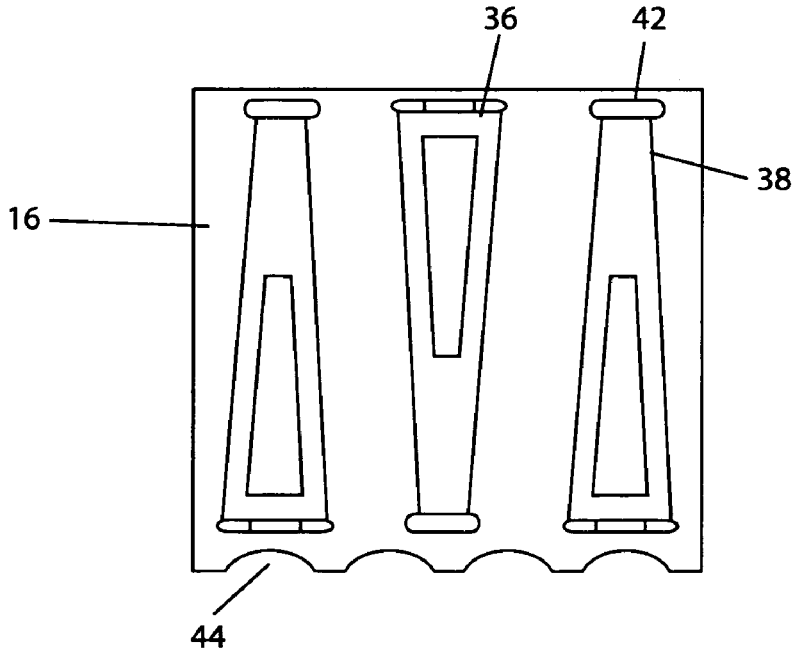
FIG. 6 is a detail perspective view of the underside of the seat, showing a plurality of pivotable legs.

Referring now to FIG. 6, a plurality of legs 20 are arranged along the underside or edge of the platform 16. It has been found that two to four legs 20 provide a good tradeoff between weight support (which is advantageously maximized) and bulk storable size (which is advantageously minimized). However, the platform may have one or more than four legs, as will be understood by those skilled in the art and further exemplarily illustrated in FIGS. 2 and 3. As shown, a constrained end 36 of the legs 20 is advantageously pivotally attached to the underside of the platform 16 and a free end 38 of the legs 20 is preferably removeably attached to the underside of the platform 16 by a holding clip or strap 40. The free end 38 of the legs 20 may be footed 42 or otherwise flared to distribute the weight of the seated golfer and reduce damage to the underlying grass or ground. Also, the legs 20 may be telescoping or cooperatively pivotable such that one or more nested portions are arranged within or alongside the leg 20 in order to provide a seat that features a platform 16 with a height that is greater than the platform 16 length or provides for a shorter stored length. The legs 20 may be made of any suitably strong material such as metal, plastic, resin, wood, composites, combinations thereof and the like.

In operation, referring back to FIGS. 1-3, when the golf bag 10 is not being used or when the golfer is carrying the golf bag 10, the seat is preferably in the non-deployed position of FIG. 1, with the platform 16 length generally parallel to the golf bag 10 length. The platform 16 may be arranged within a pocket (not shown). When the golfer elects to sit down, the golfer pivots the platform 16 to the partially deployed position of FIG. 2, with the platform 16 length generally parallel to the ground. The golfer then removes the free end 38 of the legs 20 from the clip 40 and pivots the legs 20 to the fully deployed position of FIG. 3, with the free ends 38 supported by the ground or other support structure.

Features are advantageously incorporated into the platform 16 in addition to seating ability. For example, one or more grooves or notches 44 may be formed into an edge of the platform 16. The notches 44 are advantageously sized and configured to cradle a golf club 4 shaft such that the golf club 4 can be propped up while within the notch 44 and inhibited from sliding from the platform 16 edge onto the ground. For another example, a cup holder may be recessed or hollowed into the platform 16. For another example, the platform 16 can provide a suitable writing surface such that the golfer can write and maintain his or her score via a scorecard.

Although this invention has been described in terms of certain exemplary uses, preferred embodiments and possible modifications thereto, other uses, embodiments, and possible modifications apparent to those of ordinary skill in the art are also within the spirit and scope of this invention. It is also understood that various aspects of one or more features of this invention can be used or interchanged with various aspects of one or more other features on this invention. Accordingly, the scope of this invention is intended to be defined only by the claims that follow.

What is claimed is:

1. A golf bag having an integrated seating platform, comprising:

a generally tubular body for housing a plurality of golf clubs;

a support stand that extends from the tubular body to a ground support surface effective to vertically support the tubular body;

a generally solid and flat platform sized and configured to accept and support a seated golfer, the platform having a plurality of legs attached thereto that are extendable to the ground support surface; and a coupler having a plurality of flexible rods attached to the seating platform that are sized and configured to be rotatably secured within a pair of tubes that are attached to the tubular body effective to interconnect the tubular body to the platform.

2. The golf bag of claim 1, wherein the platform is removeably attached to the tubular body by the tubes of the coupler.

3. A golf bag having an integrated seating platform, comprising:

a generally tubular body for housing a plurality of golf clubs having a stand that vertically supports the tubular body;

a generally solid and flat platform sized and configured to accept and support a seated golfer, the platform having a plurality of legs attached thereto that are extendable to a ground support surface effective to fully support the weight of the seated golfer together with the tubular body and stand, each leg having a constrained end and a free end with the constrained end pivotally attached to the platform and the free end removeably attached to the platform; and a coupler having a plurality of flexible rods having a circular cross-sectional geometry attached to the seating platform that are sized and configured to be rotatably secured within a pair of tubes having a circular cross sectional geometry that are attached to the golf bag effective to removably interconnect the tubular body to the platform.

4. The golf bag of claim 3, wherein a plurality of pairs of tubes are vertically arranged along the height of the tubular body and the flexible rods are secured within any pair of the plurality of pairs of tubes to provide for platform height adjustability.

5. The golf bag of claim 4, wherein a first end of the flexible rods are formed in unity with the platform and a second opposite end of the flexible rods are formed in unity with the tubular body.

6. The golf bag of claim 5, wherein the flexible rods are L-shaped.

7. The golf bag of claim 6, wherein a notch is formed on an edge of the platform and sized and configured to cradle a golf club shaft.

8. The golf bag of claim 4, wherein the platform height is adjusted by moving the flexible rods from one pair of vertically arranged tubes to another pair of vertically arranged tubes.

9. A golf bag having an integrated seating platform, comprising:

a generally tubular body for housing a plurality of golf clubs having a stand that vertically supports the tubular body;

a plurality of pairs of tubes each having a circular cross sectional geometry vertically arranged along the height of the tubular body;

a generally solid and flat platform sized and configured to accept and support a seated golfer, the platform having a plurality of legs attached thereto that are extendable to a ground support surface effective to fully support the weight of the seated golfer together with the tubular body and stand, each leg having a constrained end and a free end with the constrained end pivotally attached to the platform and the free end removeably attached to the platform;

a coupler having a plurality of flexible L-shaped rods each with a first end formed in unity with the platform and a second opposite end formed in unity with the tubular body, the flexible rods also having a circular cross-sectional geometry sized and configured to be rotatably secured within any of the pairs of circular cross sectional geometry shaped tubes to removably interconnect the tubular body to the platform; and a notch formed on an edge of the platform sized and configured to cradle a golf club shaft.

* * * * *